US005280818A

United States Patent [19]

Übelhart

[11] Patent Number: 5,280,818

[45] Date of Patent: Jan. 25, 1994

[54] PULLING DEVICE, PREFERABLY TO PULL A BLIND OF A WINDOW BLIND ASSEMBLY INWARDLY AND OUTWARDLY, AND AN ASSEMBLY INCORPORATING SUCH DEVICE

[75] Inventor: Albin Übelhart, Küssnacht am Rigi, Switzerland

[73] Assignee: Sonne Regen AG, Küssnacht am Rigi, Switzerland

[21] Appl. No.: 901,400

[22] Filed: Jun. 19, 1992

[30] Foreign Application Priority Data

Jun. 21, 1991 [CH] Switzerland ..... 01830/91

[51] Int. Cl.[5] ..... A47G 5/02

[52] U.S. Cl. ..... 160/265; 160/191; 160/322; 160/267.1; 160/274

[58] Field of Search ..... 160/274, 193, 192, 191, 160/271, 265, 267.1, 280, 279, 313, 314, 189, 322

[56] References Cited

U.S. PATENT DOCUMENTS

| | | | |
|---|---|---|---|
| 794,937 | 7/1905 | Hopkins | 160/279 |
| 2,008,000 | 7/1935 | Brunst et al. | 160/192 X |
| 2,064,470 | 12/1936 | Heckman | 160/189 X |
| 2,420,301 | 5/1947 | Cusumano | 160/192 X |
| 4,739,816 | 4/1988 | Dodich et al. | 160/172 X |
| 5,113,922 | 5/1992 | Christensen et al. | 160/265 X |

FOREIGN PATENT DOCUMENTS

| | | | |
|---|---|---|---|
| 2328825 | 1/1975 | Fed. Rep. of Germany | 160/279 |
| 1009671 | 3/1952 | France | 160/279 |

*Primary Examiner*—Blair M. Johnson
*Attorney, Agent, or Firm*—Wenderoth, Lind & Ponack

[57] ABSTRACT

A pulling device, which serves preferably to pull in and out a cloth or blind of a window blind assembly, has a pulling cable. Opposite ends of the cable are mounted at the bottom ends of guide rails that are arranged on opposite sides of the cloth. From such attached ends, the cable is guided over deflecting rollers in a hollow member and is wound at least once therein around two rollers that are forced apart by a spring element, in particular a gas pressure spring. The hollow member has at opposite ends thereof respective sliding elements that guide the hollow member along the guide rails. The hollow member is attached to the end of the cloth that is to be moved. The entire length of the cloth can be pulled outwardly uniformly by the pulling device.

43 Claims, 3 Drawing Sheets

PULLING DEVICE, PREFERABLY TO PULL A BLIND OF A WINDOW BLIND ASSEMBLY INWARDLY AND OUTWARDLY, AND AN ASSEMBLY INCORPORATING SUCH DEVICE

BACKGROUND OF THE INVENTION

The invention relates to a pulling device, preferably to pull inwardly and outwardly a blind of a window blind assembly, and including at least one pulling cable that is wound on and off rollers, that engages with ends of the blind to be moved and that exerts a constant pulling force on the cloth by means of a spring element engaging a movable roller. The invention also relates to a window blind assembly incorporating such device.

This general type of pulling device is suitable especially for window blind assemblies, where a blind that protects against the sun is pulled out at least partially horizontally or at a slightly inclined angle. Such known pulling device includes a steel strip which can be wound or unwound over deflecting rollers onto a roller attached coaxially on the side of a shaft onto which the blind is wound. Such strips are positioned at opposite sides of the end of the blind to be moved. To generate the tensioning of the steel strips and thus also the blind, this conventional pulling device includes a deflecting roller which turns each steel strip by 180° and is connected to a gas pressure spring. Such a pulling device is integrated into the guide rails disposed on each side of the blind. However, this device has the drawbacks that with such an arrangement of the pulling device the cross section of the guide rails must be relatively solid and even the shaft for winding the blind must be rather solid on the side thereof with the takeup rollers attached to the shaft for the steel strip. In the case of a window blind assembly, for example that is mounted outside a window in a garden, this can lead to space difficulties. In addition, from an aesthetic point of view it is not ideal if such sturdy guide rails and shafts are required.

SUMMARY OF THE INVENTION

Therefore, the object of the present invention is to provide a pulling device of the above described type and a related blind assembly that with improved functionality require less space and additionally are very simple and thus inexpensive.

This object is achieved by the invention in that the pulling cable engaging with the end of the blind to be moved is fixed at an end at a location corresponding to a terminal position of the pulled out blind and is directly or by means of one or several deflecting rollers wound once or several times around at least two rollers which are forced apart by a spring element. In this manner, the pulling cable of the pulling device of the invention can be wound or unwound independently and separately, whereby the pulling device requires a minimum of space and also enable in many cases the easy installation of a window blind assembly.

The rollers, that can be moved toward and away from each other, and the spring element are integrated into a housing and form together with the pulling cable a separate unit. In this manner, the pulling device of the invention can be fabricated independently of the dimensions of the window blinds which are normally designed very individually. Therefore, the pulling device of the invention can be produced quite inexpensively as a construction kit. In addition, the pulling device is significantly better protected against the effects of raw weather due to its compactness than are existing systems. The very compact design of the pulling device is also due to the circumstance that the spring element is located in an advantageous manner between the rollers around which the pulling cable is wound and is designed as a gas pressure spring.

The invention is fulfilled in an ideal manner if the pulling device uses for the spring element a gas pressure spring which generates the stroke and a spring force in each stroke position and to which is attached on opposite sides thereof respective of the rollers, each of which is rotatable in a carriage and around which the cable is wound several times in an advantageous manner. The carriages and rollers are housed together with the gas pressure spring in a housing. The housing in turn is installed in a preferred embodiment in a hollow member which is attached detachably to the end of the blind to be moved and which has a length corresponding approximately to the width of the blind. The cable is pulled out from opposite ends of the hollow member and passes over the deflecting rollers, with opposite cable ends fixed at locations corresponding to the terminal position of the pulled out blind.

In another arrangement, the housing is aligned with longitudinal expansion in the direction of adjustment and on the side of the blind.

A window blind assembly with the pulling device according to the invention has a drive shaft which can rotate and wind up and unwind the blind, and guide rails which position opposite sides of the movable end of the blind. Thus, the pulling device is provided as a separate unit from the drive shaft that winds up the blind and from the guide rails. In this manner, the pulling device enables low space requirements and excellent functionality.

Each end of the housing attached to the end of the blind is held by a slide element, which is attached detachably to the housing and has at least one, preferably two sliders, which travel in the guide rail and support rotatably the deflecting roller, by means of which the cable is led onto the rollers.

BRIEF DESCRIPTION OF THE DRAWINGS

Embodiments and other advantages of the invention are explained in detail with reference to the drawings.

DETAILED DESCRIPTION OF THE INVENTION

Figure 1:
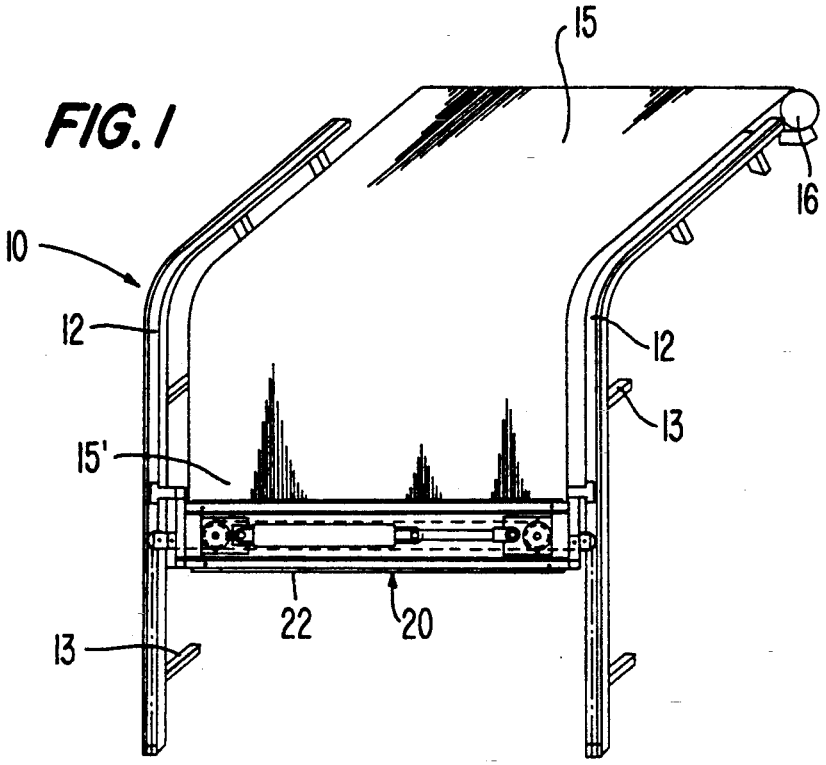
FIG. 1 is a schematic perspective view, partially in section, of a window blind with a pulling device according to the invention.

FIG. 1 shows a window blind assembly 10, known also as a window awning or pergola and whose actual purpose is to protect a room from the sun shining in, as desired. To reach this goal, a blind such as a cloth 15 or the like, or for example a louvered blind, can be pulled out along guide rails 12 arranged on both sides of the cloth 15. The cloth 15 can be wound or unwound on a drive shaft 16, which can be rotated by hand or machine to thereby roll up or unroll the blind or cloth. The shaft 16 and the guide rails 12 can be mounted by means of brackets 13, for example, to a construction of a winter garden or the like that is not shown in detail.

An outer end 15' of cloth 15 that is to be moved along the guide rails 12 is attached detachably to a hollow member 22 having a length that corresponds approximately to the width of cloth 15 and that is part of a pulling device 20 according to the invention. The opposite cloth end is held detachably on the drive shaft 16. The pulling device 20 enables the cloth 15 to be moved flawlessly and stretched in an advantageous manner in the upper runs of the guide rails that may be inclined slightly from the horizontal. The constant pulling force that is generated by the pulling device itself causes a tendency for the cloth to be actually continuously pulled out, but the drive of the shaft 16 acts against this tendency. When such drive is reversed or retarded, the counterforce of such drive is decreased in such a manner that the cloth travels out at a specific velocity. In contrast, during a process of winding up the cloth, a counterforce exceeding the pulling force of the pulling device is generated by the drive.

Figure 2:
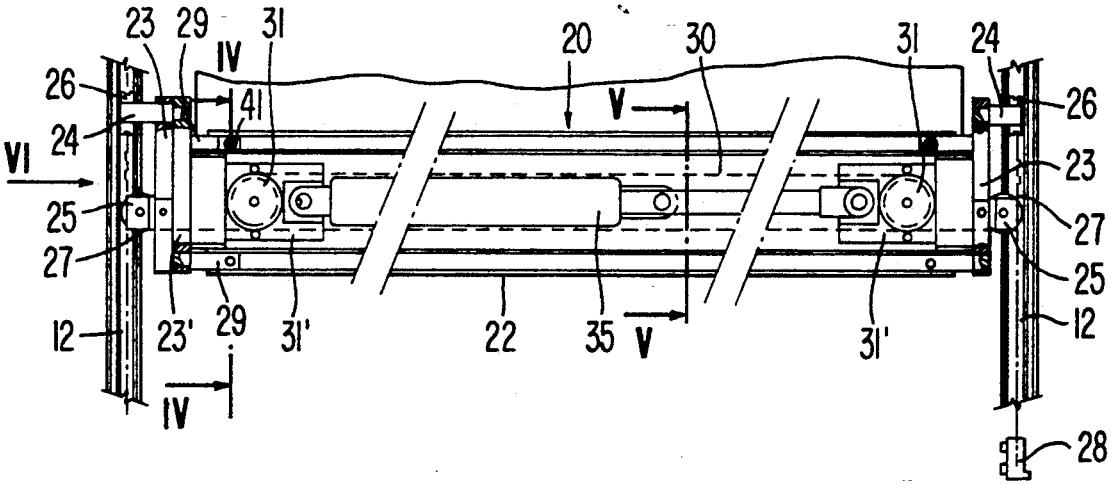
FIG. 2 is an elevation view of the pulling device according to the invention.

As shown in FIG. 2, provided at each of opposite ends or sides of the hollow member 22 of pulling device 20 is a respective sliding element 23 having two sliders 24 and 25 which are guided movably in the respective guide rail 12, thus guiding cloth 15 along rails 12. According to the invention the pulling device 20 has a pulling cable 30, opposite ends of which are fixed to lower ends of respective guide rails 12. From each end, cable 30 is led over respective deflecting rollers 26, 27 on respective sliders 24, 25 and then into the hollow member 22. Within member 22 cable 30 is wound up around and between two rollers 31 which can be moved longitudinally within a housing 22' mounted to the hollow member 22. The rollers 31 are rotatable within respective carriages 31'. A gas pressure spring 35 designed as a spring element is connected to the rollers 31 or to carriages 31' and acts tc urge rollers 31 apart. A uniform tensioning force is produced on the cable 30 wound around the rollers 31 in each position of cloth 15 and thus of cable 30. Also, due to the allowable stroke adjustment of spring 35, for example 500 millimeters, the amount of the cable 30 guided around the two rollers 31 will be decreased or increased, depending on the displacement direction of the cloth 15 along the guide rails. Thus, the cable can be released or taken up during movement between the uppermost and the bottommost positions of the cloth, and this will occur uniformly on both sides. Furthermore, two more gas pressure springs 35 can be provided between the rollers 31 in order to be able to prolong the winding up or unwinding of the cable.

The ends of the cable 30 are fixed by means of clamps 28 that can be mounted on the lower ends of the guide rails 12. The cable is guided starting from these ends back over the upper deflecting rollers 26 onto the bottom deflecting rollers 27 and from there, offset by 90° through boreholes 23' in the sliding elements 23, and around the rollers 31. Cable 30 can be a wire cable, but could in principle also be a strip or belt, a chain or similar element, and can be made of metal or plastic.

Thus, the pulling device 20 is provided as a unit that is independent and separate from the drive shaft 16 on which the cloth is wound and from the guide rails 12. Thus, the guide rails 12 may be of a minimum size. Compared to known systems, pulling device 20 also has the advantage that the cable does not move within and along the guide rails 12. Thus, no dragging or friction on the cable occurs and as a result there is significantly less wear of the cable. Owing to this stationary design, less susceptibility to dirt and better protection against the effects of weather can be obtained. Similarly, device 20 can be rapidly and simply maintained and repaired, and thus both maintenance and repair operations can be reduced to a minimum.

Furthermore, depending upon requirements for a given installation, two more more gas pressure springs or even entire pulling devices can be provided in series or parallel arrangement, thus lengthening in particular the displacement path of the cable and altering the pulling force.

Figure 3:
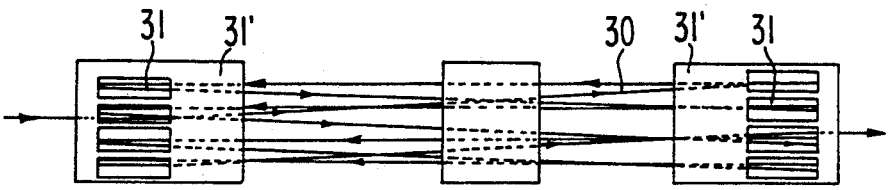
FIG. 3 is a schematic, top view of rollers of the pulling device and around which a cable pull is wound.

FIG. 3 is a schematic view showing how pulling cable pull 30 is wound around the rollers 31. The wire cable is looped four times around each roller. It is self evident that the more windings are provided, the greater will be the displacement path of the cloth during the maximum stroke of the gas pressure spring, assumed to be constant. Therefore, it is another advantage of the present invention that one can adjust in a simple manner to the pull out lengths and pull forces that vary widely in operational practice for window blinds. In addition, the variety of available sizes and spring pressure outputs of gas pressure springs enables a flexible adaptation to particular required conditions.

Figure 4:
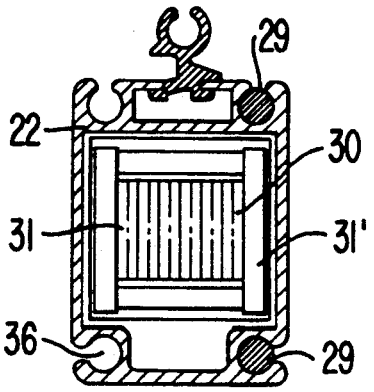
FIG. 4 is a cross sectional view of the pulling device along line IV—IV in FIG. 2.

FIG. 4 is a sectional view of a hollow member 22 made of aluminum and connectable detachably to the cloth 15 by means of a weatherstrip connection. The hollow member is predominantly a rectangular box, each corner of which has a longitudinal groove 36. A rod or rods 29 of a sliding element 23 extend into and fixed by respective clamping screws 41 in one or more longitudinal grooves on the same side (or diagonally). In addition, FIG. 4 shows cable 30 wound six times around movable and rotatable roller 31 and the carriage 31 thereof.

Figure 5:
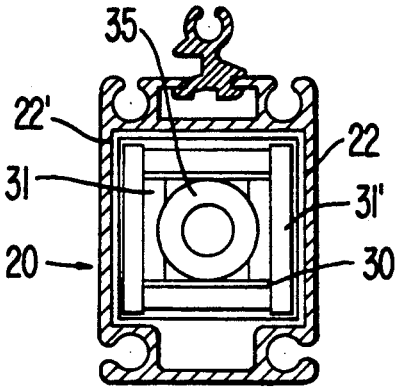
FIG. 5 is a cross sectional view of the pulling device along line V—V in FIG. 2.

FIG. 5 shows in the center of the hollow member 22 the gas pressure spring 35 which is arranged between runs of the cable 30 and also illustrates the compactness of the pulling device 20. Furthermore, the second roller 31, which can be moved behind the gas pressure spring 35, is also visible.

Figure 6:
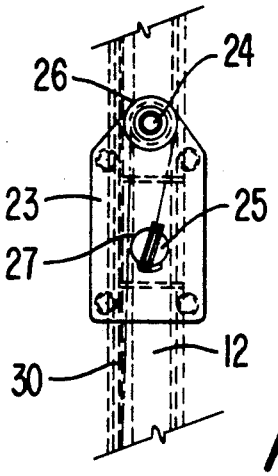
FIG. 6 is a side view of the pulling device in the direction of arrow VI in FIG. 2.
Figure 7:
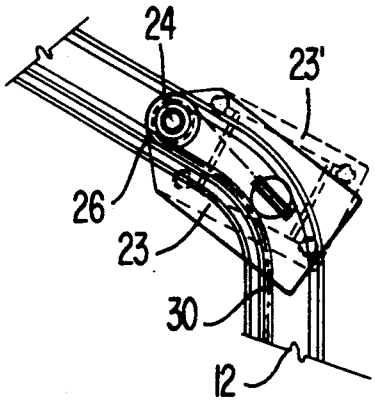
FIG. 7 is a corresponding side view, but with a curved guide rail.

FIG. 6 illustrates the arrangement of the sliding element 23 in a rectilinear portion of the respective guide rail 12. The upper slider 24 of the sliding element 23 is a cone and supports deflecting roller 26 that can be rotated relative to the cone. The cone and roller together engage as a sliding block with a longitudinal groove formed by the guide rail 12. In contrast, the bottom slider 25 is a cone having a forked recess, in which a deflecting roller 27 in turn can be rotated. The cable 30 extends upwardly in the guide rail 12 as far as the deflecting roller 26 and is deflected thereby downwardly back to the bottom deflecting roller 27. The slider 25 also can be rotated in the sliding element 23, so that deflecting roller 27 can be adjusted to the variations in the angle of the cable. According to FIG. 7, an inner part 23' of the sliding element 23, which comprises two identical parts, pivots around the axis of the upper slider 24 when sliding element 23 is in a curved part of guide rail 12. Thus, it is ensured that the hollow member 22 does not become wedged into curved portions of the guide rails. Sliding element 23 is suited especially for guide rails with a radius of curvature of less than 20 to 30 centimeters.

Figure 8:
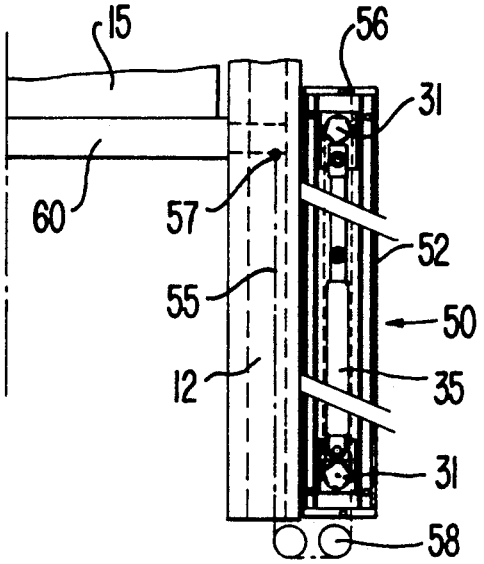
FIG. 8 is a sectional view of a pulling device arranged laterally along a guide rail.

FIG. 8 shows an embodiment wherein a housing 52 of a pulling device 50 extends parallel to and is attached to a bottom portion of the guide rail 12. The difference of this pulling device 50 involves the differently guided cable 55 thereof. Cable 55 also is wound around and between the rollers 31 which can be moved apart by a gas pressure spring 35 that tensions the cable by a spring force. However, one end 56 of cable 55 is attached to the housing 52, whereas its opposite end 57 is attached to a rod 60 attached detachably to the cloth 15 by clamping means, not shown in detail. The cable 55 is guided at the bottom out of the housing 52 and over two deflecting rollers 58 into the guide rail 12 as far as the rod 60. The rod 60 can slide in the guide rail 12 and is pulled towards the bottom by the cable 55 according to the same principle as in the first embodiment, whereby the cloth is tensioned approximately the same in each pulled out position. However, in this embodiment a separate pulling device 50 is provided for each guide rail. This design is advantageous particularly for narrow blinds with larger unrolling. The guide rails can in principle be horizontal, vertical or extend at any arbitrary angle. Furthermore, the pulling device 50 could be arranged in the direction of and on the bottom end of the guide rail, in which arrangement no deflecting rollers would be necessary. This embodiment is not connected to the window blind, and could be attached, for example, to a wall, whereby the blind assembly also could be designed without guide rails.

Figure 9:
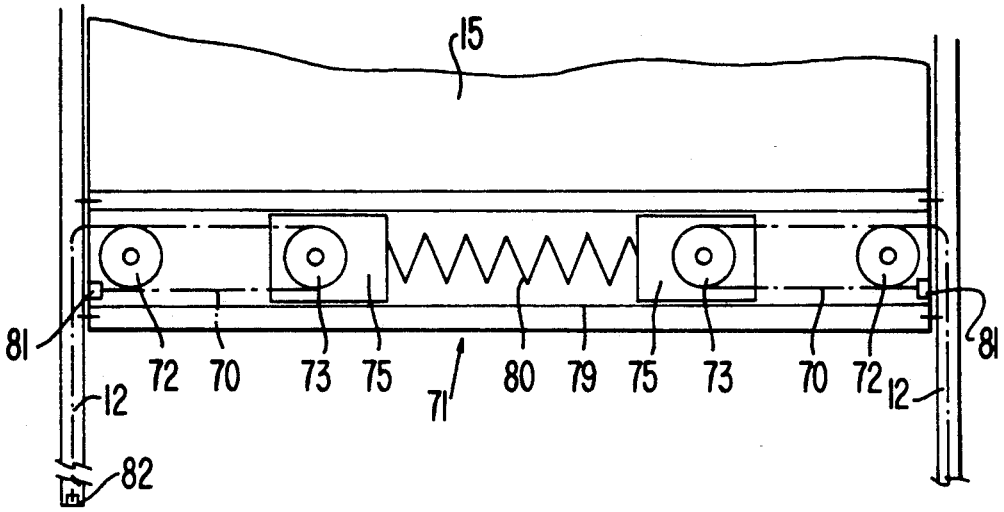
FIG. 9 is an elevation view of a schematically illustrated variation of a pulling device.

The pulling device 71 shown schematically in FIG. 9 has a housing 79, in which a separate cable 70 is provided for each guide rail 12. Each cable 70 is wound around and between two respective rollers 72, 73. Each outer roller 72 is stationary, whereas the inner roller 73 is rotatable within a carriage 75 and can be moved longitudinally within housing 79 toward roller 72. A tension spring 80 is connected to the two inner rollers 73 or to the carriages 75 thereof. Spring 80 pulls rollers 73 toward each other and thus pulls rollers 73 apart from respective rollers 72. Thus, a tractive force is exerted on the pulling cables 70. One end 81 of each cable 70 is securely clamped in the housing 79 and an opposite end 82 is fixed to the respective rail 12 at a location corresponding to the terminal or lowermost position of the cloth 15. In service this pulling device 71 functions like that of the embodiment of FIG. 1. That is, when the blind is let down by means of drive, not shown, the inner rollers 73 move owing to the approximately constant tractive force toward the center of the housing 79, and the cable that is released from the guide rails 12 is wound on rollers 72 and the rollers 73 that are moving apart from rollers 72.

Figure 10:
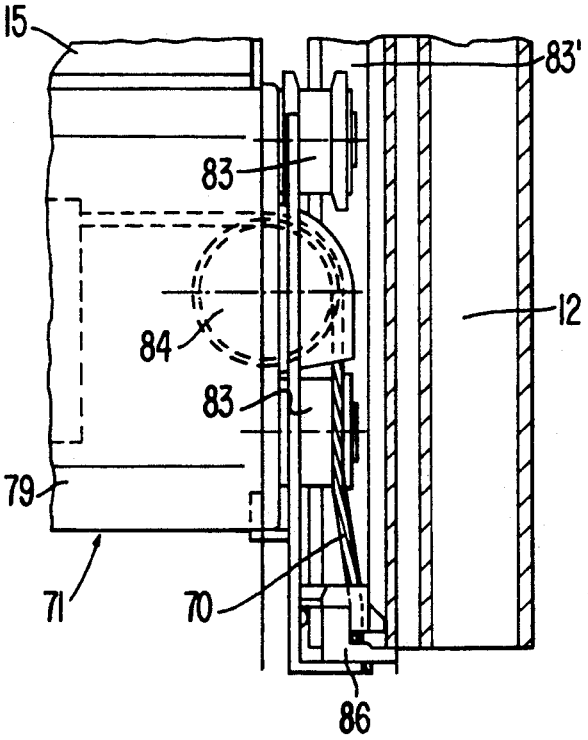
FIGS. 10 and 11 are fragmentary and end views, respectively, of a guide of a pulling device in a guide rail.
Figure 11:
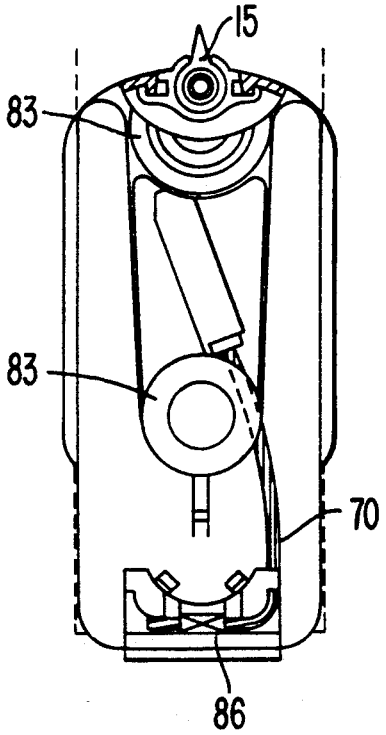

FIG. 10 and FIG. 11 show variations of guiding of the pulling device 71 in the guide rail 12. The pulling device 71 has at each opposite end of housing 79 two rollers 83, which are shaped like slide blocks and that are rotatably mounted above each other and which slide in respective vertical T-shaped grooves 83' in the guide rail 12. Between these two rollers 83 is removably positioned a deflecting roller 84, provided with diagonal axis, that can be rotated in the housing 79 in a manner such that the cable 70 is steered around the bottom roller 83. The cable end is attached to a screw clamp 86. The deflecting roller 84 can be inserted in various ways into the housing, so that the cable can be guided to the left or the right around the bottom roller 83, depending on whether the deflecting roller 84 is mounted on the left or the right on the front side of the housing 79.

The pulling device according to the invention also can be used for purposes other than for window blinds, thus for example to open and close gates of any kind.

I claim:

1. A pulling device for controlling winding and unwinding of a blind of a window blind assembly wherein a first end of the blind is connected to a drive shaft to enable the blind to be wound upon the drive shaft and including a spaced pair of guide rails to guide opposite side edges of the blind as the blind is wound on and unwound from the drive shaft, said pulling device comprising:

a member supporting at least two rollers, at least a first said roller being movable toward and away from a second said roller;

a cable having opposite first and second ends, at least said first cable end being adapted to be fixed relative to a first guide rail, said second cable end being adapted to be fixed relative to one of a second end of the blind or a second guide rail, and a portion of said cable between said first and second ends thereof being wrapped at least once around said two rollers; and a spring element operably mounted and positioned between said two rollers to exert a spring force on at least said first roller to urge said first roller in a direction away from said second roller, thereby to exert a constant pulling force on said cable between said first and second ends thereof, as a result of which a constant pulling force can be exerted on the second end of the blind.

2. A device as claimed in claim 1, wherein said cable is formed of metal material.

3. A device as claimed in claim 1, wherein said cable is formed of plastic material.

4. A device as claimed in claim 1, wherein said cable comprises a wire cable.

5. A device as claimed in claim 1, wherein said cable comprises a belt.

6. A device as claimed in claim 1, wherein said cable comprises a chain.

7. A device as claimed in claim 1, wherein said spring element comprises at least one gas pressure spring.

8. A device as claimed in claim 1, wherein said member and two rollers, said cable and said spring element comprise a separate detachably mountable unit.

9. A device as claimed in claim 1, wherein said member is a hollow member, and said rollers and said spring element are positioned within said hollow member.

10. A device as claimed in claim 1, wherein said first and second rollers are mounted rotatably on respective first and second carriages mounted for sliding movement relative to said member, said spring element has opposite first and second ends attached respectively to said first and second carriages, such that said spring element urges said first and second carriages and said first and second rollers away from each other.

11. A device as claimed in claim 1, further comprising respective guide members mounted on respective opposite longitudinal ends of said member for engaging respective guide rails to guide movement of the second end of the blind during winding and unwinding thereof.

12. A device as claimed in claim 11, wherein each said guide member comprises a sliding element attached to said respective member end and having at least one slider to be movable along the respective guide rail and supporting a deflecting roller for deflectingly guiding said cable.

13. A device as claimed in claim 12, wherein said sliding element has first and second said sliders and respective said deflecting rollers.

14. A device as claimed in claim 13, wherein said sliding element includes first and second pivotally connected parts, said first part being attached to said member end, and said second part being pivoted to said first part about an axis of said first slider and supporting said second slider.

15. A device as claimed in claim 1, further comprising, at each opposite longitudinal end of said member, a pair of slide rollers for sliding in a respective guide rail and over which passes said cable, and a deflecting roller positioned between said pair of slide rollers and mounted relative to said member for tilting movement to deflect said cable relative to said slide rollers.

16. A device as claimed in claim 1, wherein said cable is wrapped plural times around said two rollers.

17. In a window blind assembly including a drive shaft, a blind having a first end connected to said drive shaft to enable said blind to be wound upon said drive shaft and a second end, and spaced first and second guide rails positioned to guide opposite side edges of said blind as said blind is wound on and unwound from said drive shaft, the improvement comprising a pulling device for controlling winding and unwinding of said blind, said pulling device comprising:

a member supporting at least two rollers, at least a first said roller being movable toward and away from a second said roller;

a cable having opposite first and second ends, at least said first cable end being fixed to said first guide rail at a location corresponding to a terminal position of said blind when said blind is maximally unwound from said drive shaft, said second cable end being fixed relative to one of said second end of said blind or a second said guide rail, and a portion of said cable between said first and second ends thereof being wrapped at least once around said two rollers; and a spring element operably mounted to exert a spring force on at least said first roller to urge said first roller in a direction away from said second roller, thereby to exert a constant pulling force on said cable between said first and second ends thereof, as a result of which a constant pulling force is exerted on said second end of said blind.

18. The improvement claimed in claim 17, wherein said blind comprises a length of cloth.

19. The improvement claimed in claim 17, wherein said blind comprises louvers.

20. The improvement claimed in claim 17, wherein said cable is formed of metal material.

21. The improvement claimed in claim 17, wherein said cable is formed of plastic material.

22. The improvement claimed in claim 17, wherein said cable comprises a wire cable.

23. The improvement claimed in claim 17, wherein said cable comprises a belt.

24. The improvement claimed in claim 17, wherein said cable comprises a chain.

25. The improvement claimed in claim 17, wherein said cable is wrapped plural times around said two rollers.

26. The improvement claimed in claim 17, wherein said spring element comprises at least one gas pressure spring.

27. The improvement claimed in claim 17, wherein said member and two rollers, said cable and said spring element comprise a separate detachable unit independent of said drive shaft, said blind and said guide rails.

28. The improvement claimed in claim 17, wherein said member is a hollow member, and said rollers and said spring element are positioned within said hollow member.

29. The improvement claimed in claim 17, wherein said member is attached to said second end of said blind to extend longitudinally in a direction transverse to directions of movement of said blind during winding and unwinding thereof.

30. The improvement claimed in claim 29, wherein said spring element is positioned between said two rollers.

31. The improvement claimed in claim 30, wherein said first and second rollers are mounted rotatably on respective first and second carriages mounted for sliding movement in said direction relative to said member, said spring element has opposite first and second ends attached respectively to said first and second carriages, such that said spring element urges said first and second carriages and said first and second rollers away from each other, and said first and second cable ends are fixed to said first and second guide rails.

32. The improvement claimed in claim 29, further comprising respective guide members mounted on respective opposite longitudinal ends of said member for engaging respective said guide rails to guide movement of said second end of said blind during winding and unwinding thereof.

33. The improvement claimed in claim 32, wherein each said guide member comprises a sliding element attached to said respective member end and having at least one slider movable along said respective guide rail and supporting a deflecting roller for deflecting guiding said cable.

34. The improvement claimed in claim 33, wherein said sliding element has first and second said sliders and respective said deflecting rollers.

35. The improvement claimed in claim 34, wherein said sliding element includes first and second pivotally connected parts, said first part being attached to said member end, and said second part being pivoted to said first part about an axis of said first slider and supporting said second slider.

36. The improvement claimed in claim 29, wherein said member supports two pairs of rollers, each said roller pair including respective said first and second rollers, and comprising two said cables each having a first end fixed to a respective said guide rail, a second end fixed to said member, and a portion between said first and second ends wrapped around a respective said roller pair.

37. The improvement claimed in claim 36, wherein said spring element is positioned between said roller pairs.

38. The improvement claimed in claim 37, wherein said first rollers of said two roller pairs are mounted rotatably on respective carriages mounted for sliding movement in said direction relative to said member and relative to respective said second rollers, and said spring element comprises a tension spring having opposite ends attached to respective said carriages, such that said spring urges said carriages and said first rollers toward each other and away from respective said second rollers, thereby tensioning both said cables.

39. The improvement claimed in claim 29, further comprising, at each opposite longitudinal end of said member, a pair of slide rollers for sliding in a respective said guide rail and over which passes said cable, and a deflecting roller positioned between said pair of slide rollers and mounted relative to said member for tilting movement to deflect said cable relative to said slide rollers.

40. The improvement claimed in claim 17, wherein said member is attached to one of said guide rails to extend longitudinally in a direction parallel to directions of movement of said blind during winding and unwinding thereof.

41. The improvement claimed in claim 40, wherein said second cable end is attached to said second end of said blind.

42. The improvement claimed in claim 40, wherein said spring element is positioned between said two rollers.

43. The improvement claimed in claim 42, wherein said first and second rollers are mounted rotatably on respective first and second carriages mounted for sliding movement in said direction relative to said member, said spring element has opposite first and second ends attached respectively to said first and second carriages, such that said spring element urges said first and second carriages and said first and second rollers away from each other, and said first and second cable ends are fixed to said first and second guide rails.

* * * * *